US006910338B2

(12) United States Patent
Boukas

(10) Patent No.: US 6,910,338 B2
(45) Date of Patent: Jun. 28, 2005

(54) APPARATUS FOR COOLING LIQUID IN A PORTABLE CONTAINER

(76) Inventor: Alexander Boukas, 14695 Main Rd., Mattituck, NY (US) 11952

( * ) Notice: Subject to any disclaimer, the term of this patent is extended or adjusted under 35 U.S.C. 154(b) by 0 days.

(21) Appl. No.: 10/663,369

(22) Filed: Sep. 16, 2003

(65) Prior Publication Data

US 2005/0056028 A1 Mar. 17, 2005

(51) Int. Cl.[7] ..... F25B 9/00
(52) U.S. Cl. ..... 62/86; 62/457.9
(58) Field of Search ..... 62/60, 86, 294, 62/457.9, 457.1, 457.3, 457.4, 304, 338, 371, 386

(56) References Cited

U.S. PATENT DOCUMENTS

| | | | | | |
|---|---|---|---|---|---|
| 3,525,236 | A | * | 8/1970 | Solhkhah | 62/294 |
| 3,747,365 | A | * | 7/1973 | Nicholds | 62/51.2 |
| 4,640,101 | A | * | 2/1987 | Johnson | 62/294 |
| 5,065,879 | A | * | 11/1991 | King | 220/739 |
| 5,447,039 | A | * | 9/1995 | Allison | 62/293 |
| 5,497,918 | A | * | 3/1996 | Brilanchik | 222/626 |
| 5,692,381 | A | * | 12/1997 | Garrett | 62/60 |
| 5,718,124 | A | * | 2/1998 | Senecal | 62/457.6 |
| 5,845,501 | A | * | 12/1998 | Stonehouse et al. | 62/62 |
| 6,039,207 | A | * | 3/2000 | Adamek | 220/739 |
| 6,318,453 | B1 | * | 11/2001 | Ovshinsky et al. | 165/104.12 |
| 6,615,607 | B1 | * | 9/2003 | Lee | 62/440 |
| 2003/0159448 | A1 | * | 8/2003 | Lee | 62/60 |

FOREIGN PATENT DOCUMENTS

| | | | |
|---|---|---|---|
| GB | 2169693 a | * | 7/1986 |
| JP | 06074585 A | * | 3/1994 |

* cited by examiner

*Primary Examiner*—William Doerrler
*Assistant Examiner*—Mohammad M. Ali
(74) *Attorney, Agent, or Firm*—Thomas A. O'Rourke; Budner & O'Rourke, LLP

(57) ABSTRACT

The present invention is directed to an apparatus for cooling, a liquid in a portable container. The apparatus comprises a housing having a top end and a bottom end. The bottom end is adapted to attach to the portable container. A can of compressed gas can be within the housing. The can of compressed gas can have a release valve to expel the compressed gas. A heat exchanger can be around an exterior surface of the can. The heat exchanger can be adapted to absorb heat from a warm liquid.

17 Claims, 5 Drawing Sheets

APPARATUS FOR COOLING LIQUID IN A PORTABLE CONTAINER

BACKGROUND OF THE INVENTION

Portable water sources have proved invaluable in a wide array of situations. For example, many sports teams have water containers that they bring to practice facilities and training sites. Also, campers, hikers and backpackers have used portable liquid containers for excursions in remote areas. However, in most situations the container is typically placed in an open area, such as a field or on a travel pack. In this manner, the container is exposed to environmental conditions, especially the sun. Exposure to the sun can heat the liquid in the container; thus, eliminating the refreshing sensation provided by a cool liquid. Also, in many instances, a person can be out in the field for long periods of time and away from a source of ice for cool beverages. In some situations, ingesting a warm or hot liquid will not always quench the thirst sensation.

One particular situation where the need for a cooling device for liquid in a portable container is ever present is in the military. Soldiers must be prepared for multiple environments and climates at all times. In many tropical or desert environment, the average temperature may reach 100 degrees Fahrenheit or higher. In these situations, hydration is essential. Also, soldiers may use their water supply to clean wounds, wash their hands and face, and control their body temperature to combat exhaustion and fatigue.

Typically, soldiers will carry portable liquid containers designed for individuals. The most common portable container is the canteen. A normal canteen usually is handheld and lightweight. Canteens can be manufactured out of a hard plastic because they are light weight and prevent breaking if dropped. Due to their nature as individual use items, canteens can only hold a small amount of water and must be refilled periodically. Also, if a soldier is carrying his canteen in a desert or tropical climate and the sun has warmed the contents of his or her canteen, he or she may empty the remaining liquid because its temperature renders it unpalatable. A soldier likely will not want to carry a warmed liquid, which he or she knows will not provide a refreshing sensation when ingested.

A newer apparatus used by soldiers is the hydration system known as a CamelBak®. The hydration system is an elongated pouch which houses an amount of liquid. Attached to the pouch is a tube with a softbite valve. When a drink of water is needed, the soldier can bite down on the softbite valve and release liquid into his or her mouth. The hydration system can carry significantly more liquid then a canteen. Also, the hydration system is easier to carry, because it is worn like a backpack with a pair of shoulder straps. However, like the canteen, the hydration system is exposed to the environment and has no method or device for keeping its content cool.

Cooling device for beverage containers have been contemplated in the prior art. In U.S. Pat. No. 5,845,501 to Stonehouse et al., a shell that house liquid refrigerant is adapted to fit around the outside of a beverage container. The Stonehouse '501 device presents a significant disadvantage in that the cooling action must be transmitted through the surface of the can. The disclosure of Stonehouse '501 does not suggest that the chilling device actually contact the liquid, which would provide an instantaneous cooling effect.

A portable beverage chiller is disclosed in U.S. Pat. No. 4,460,101 to Johnson. The device in Johnson '101 is adapted to receive and enclose a beverage container. When the container is inserted into the device, it is encapsulated and cooled by a refrigerant. The Johnson patent does not suggest that the device contact the liquid itself. Nor does the patent teach that the apparatus may be attached to an opened container.

Hence, their presents a need for an apparatus that can cool a liquid in a portable container.

OBJECTS OF THE INVENTION

It is an object of the present invention to provide an apparatus for cooling a liquid in a portable container.

It is an object of the present invention to provide an apparatus for cooling a liquid in a portable container, which can be used with a canteen, open container and a hydration system.

It is an object of the present invention to provide an apparatus for cooling a liquid in a portable container which can temporarily cool a liquid and be easily replaced.

It is an object of the present invention to provide an apparatus for cooling a liquid in a portable container which is low cost and easy to manufacture.

It is an object to provide an apparatus for cooling a liquid contained in a portable liquid container for an individual's personal use.

SUMMARY OF THE INVENTION

The present invention is directed to an apparatus for cooling a liquid in a portable container preferably in the nature of a canteen or other portable beverage containing device. In one embodiment, there is container that receives a housing. The housing has a top end, a bottom end and at least on sidewall. Preferably, the housing is cylindrical, although it will be appreciated that other configurations for the cross section of the housing are possible. The bottom of the housing may be adapted to attach to the opening of a portable liquid container, including but not limited to, a canteen, open container or hydration system. This attachment may be of the turn-and-lock type, a threaded connection or other suitable connection means. One connection means that could also be used is friction fit or a releasable dimple or protrusion that is on the housing and extends into a recess in an interior portion of the container. By pushing down on the dimple the housing may be released from the container.

The top end of the housing may be open or have a cap preferably removable thereon. The top end of the can be the point at which water will be released. If a cap is used on the top end of the housing, the top end may be threaded or suitably adapted to receive the cap.

Within a portion of the housing may be a can or container having a suitable quantity of a compressed gas. Preferably, the container or can is pressurized with a release valve that is of the typical aerosol type. In one embodiment, it is self-contained and equipped with a release valve at a top end. Compressed gas can escape if the valve is depressed or pushed to one side. As gas escapes, the exterior surface of the can rapidly cool due to the reduction in gas pressure within the can.

In one embodiment, attached to the exterior surface of the can of compressed gas is a heat exchanger to speed the reduction of the temperature in the liquid present. Preferably, the heat exchanger comprises a central member with plurality of fins extending therefrom. These fins may be flat, thin objects of metal having a large relative surface area.

For example, there can be discs that are generally round thin wafers and manufactured out of aluminum or copper or other suitable heat transferring material. In another embodiment, the heat exchanger may be a porous mesh or steel wool. The heat exchanger can provide a greater surface area to transfer heat from the beverage in the container to the can holding the compressed gas thus facilitating cooling of the beverage.

In operation, the present apparatus can be removably attached to the top of a beverage container. When a user desires a cool drink, he or she can depress the release valve on the can of compressed gas. As the gas is released, the exterior surface of the container is rapidly cooled. As the user tilts the canteen up toward its mouth, its liquid flows through the housing and/or the heat exchanger. The liquid contacts the discs or porous mesh it is cooled by the container and/or the heat exchanger. Thus, when the user ingests it, a previously warm liquid is temporarily cooled to provide a refreshing and quenching sensation. A cold liquid can lower the body temperature and satisfy the thirst sensation.

In another embodiment, the container of compressed gas may be generally in the form of a circular tube having a length and a diameter. For at least a portion of its length, there is a hollow passageway for liquid in the canteen to pass through to the user for drinking. As the compressed gas is released from the container, the container is cooled. The liquid passing through the passageway is cooled by heat being transferred from the liquid to the container.

The container may be screwed into a threaded hole on a canteen, open container or hydration system. The can may provide an airtight seal when in the canteen or hydration system. The user may depress the release valve and cool the entire contents of the canteen or hydration system. This may be useful if a person is suffering from exhaustion, fatigue or sun stroke and requires a great deal of hydration and cooling.

DETAILED DESCRIPTION OF THE DRAWINGS

Figure 1:
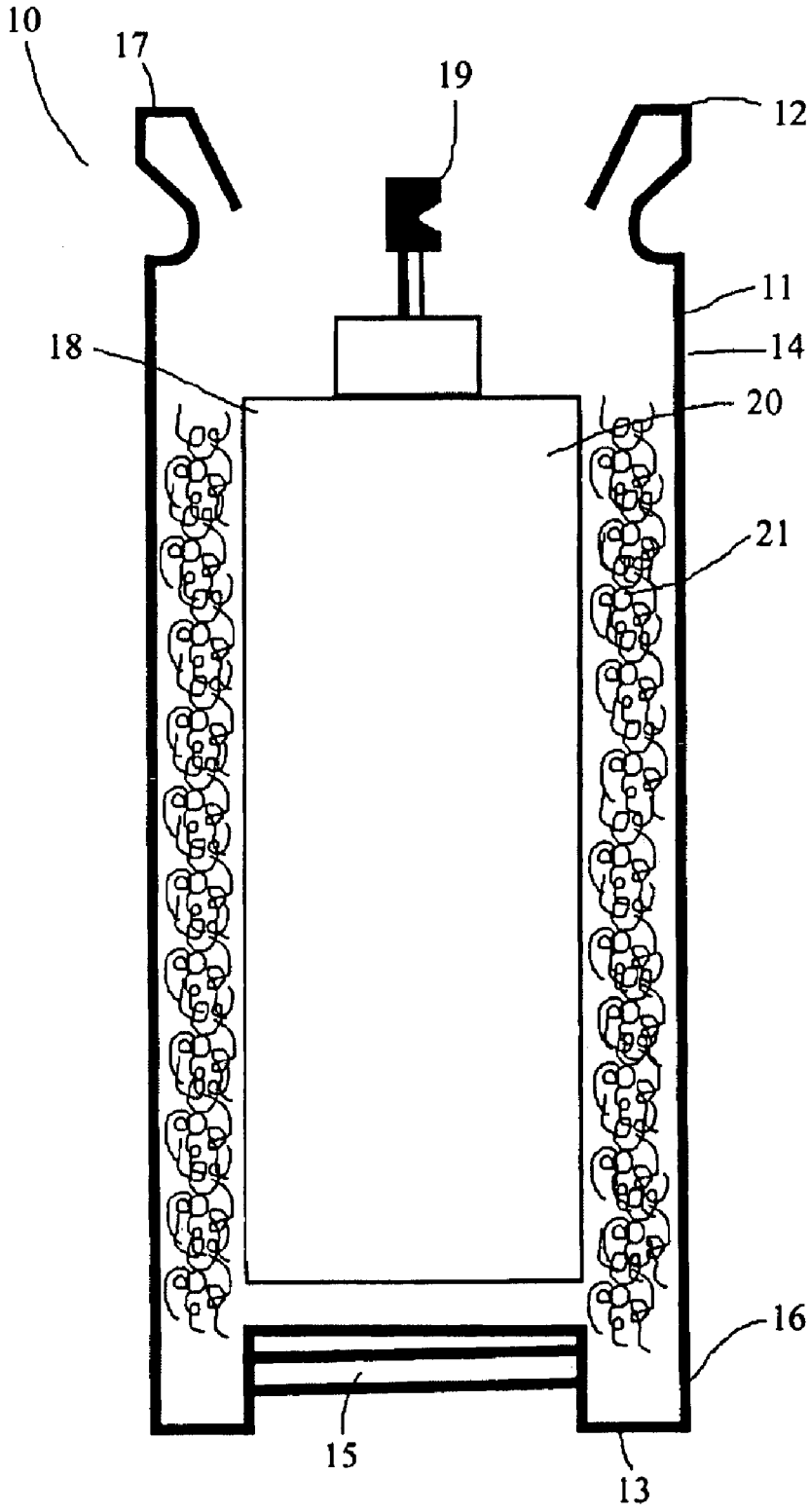
FIG. 1 is a cross-sectional view of the present invention.

The apparatus of the present invention is generally seen at 10. A housing 11 can be generally defined as having a top end 12, a bottom end 13 and a side wall 14. Preferably, housing 11 is a hollow cylinder. However, housing 11 may be any size or shape, such as rectangular or square. Also, housing 11 is preferably manufactured out of plastic. However, housing 11 may be rubber or plastic of any durability, rigid or soft.

Bottom end 13 of housing 11 may be adapted to connect to a canteen or a hydration system. Threads 15 may mate with threaded holes on canteens or hydration systems. In a preferred embodiment, bottom end 13 has threads for mating with a set of inner threads on a canteen, while a lower portion 16 of sidewall 14 has threads (not shown) to mate with a set of outer threads on a canteen or hydration system. The outer threads on a canteen or hydration system may be those which typically engage their respective caps. In an alternative embodiment, bottom end 13 of housing 11 provides an airtight fit with an inner surface of a canteen or hydration system. This airtight fit may be accomplished in any known manner, such as a rubber casing (not shown) fitted around bottom end 13.

In one embodiment, top end 12 can be equipped with a bevel 17. Bevel 17 can allow for easy pouring and drinking of the liquid. In another embodiment, top end 12 may be adapted to hold a cap when the canteen, open container or hydration system is sealed. In this manner, top end 12 may be threaded or may have a hinged cap.

Within housing 11 may be a can or container of compressed gas 18 preferably made of metal. The can of compressed gas 18 may be self-contained and equipped with a release valve 19. Preferably, when the release valve is depressed, compressed gas escapes from the can. Due to rapid pressure decrease, the can will cool simultaneously. Preferably, release valve 19 is oriented such that the compressed gas is directed away from the top end 12 of the housing 11.

Figure 2:
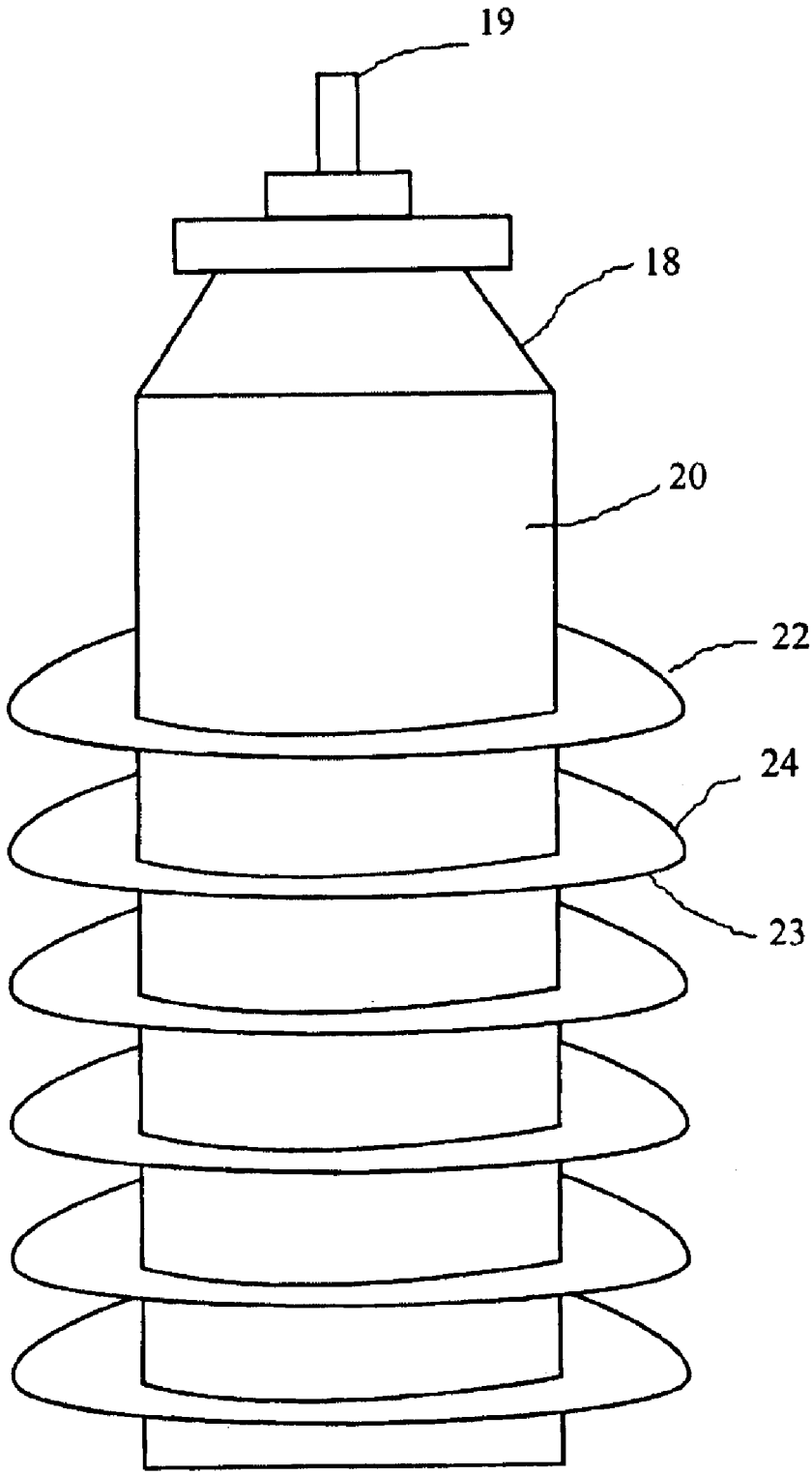
FIG. 2 is a perspective view of the can of compressed gas of the present invention.
Figure 3:
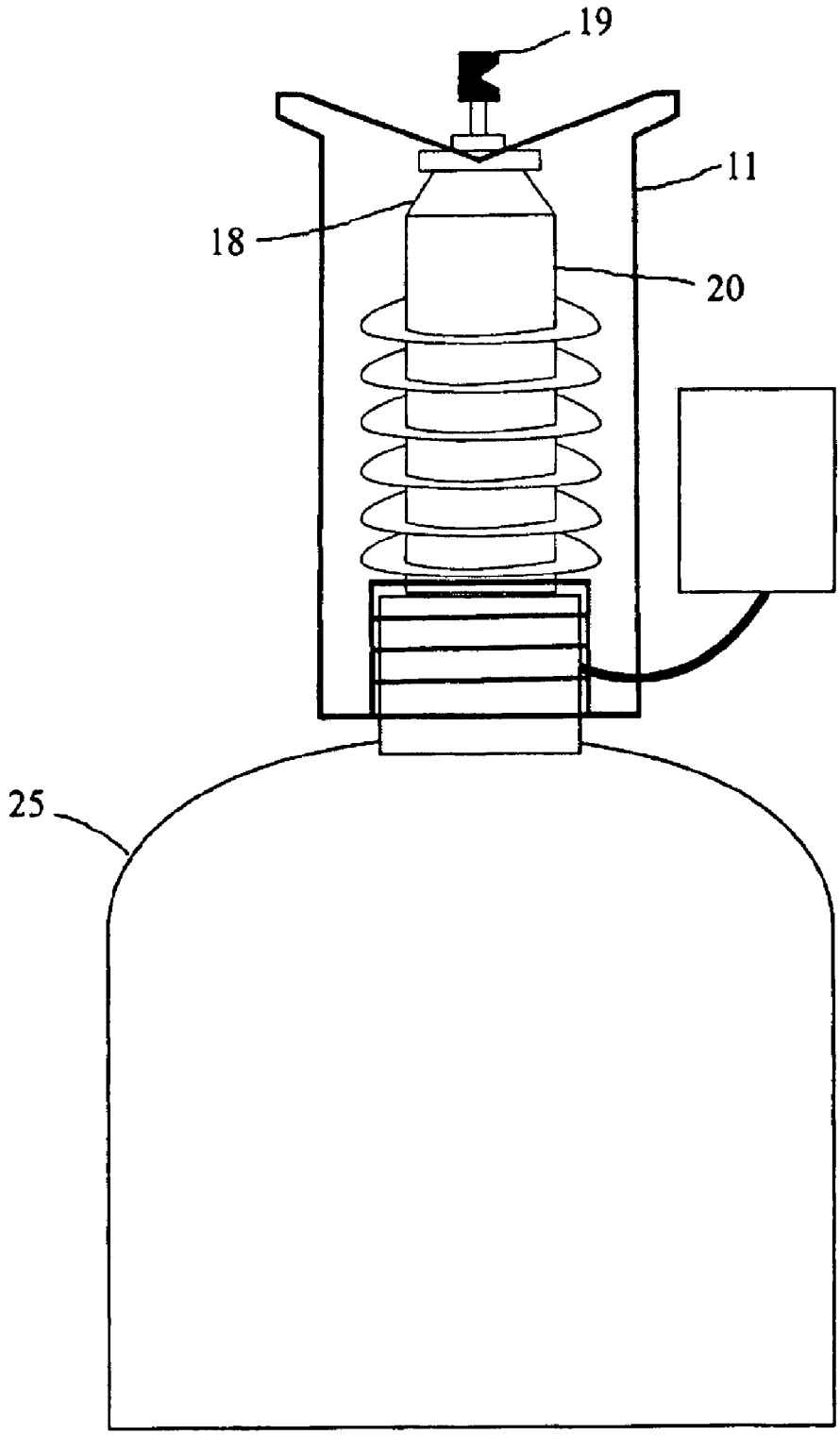
FIG. 3 is a cross-sectional view of the present invention as used with a canteen.

Around an exterior surface 20 of the can of compressed gas 18, can be a heat exchanger 21. In one embodiment, heat exchanger 21 can be a porous mesh or "steel wool" form of metal. In a second embodiment, as seen in FIG. 2, the heat exchanger 21 can be a plurality of fins 22. In both embodiments, the heat exchanger 21 can be a metal, preferably aluminum, copper, or a metal with similar thermal conductance properties. Heat exchanger 21 may serve to increase the surface area of the can of compressed gas 18, thereby spreading the lowered-temperature surfaces which the liquid may contact.

As seen in FIG. 2, fins 22 may be disc-shaped and spaced out along the exterior surface 20 of the can of compressed gas 18. Fins 22 may have a bottom surface 23 and a top surface 24. In operation, the liquid may first contact bottom surface 23 and release its heat onto the fin. Additionally, fins 22 may be of the same or different sizes, depending on the size of the housing and type of water flow desired.

In operation, housing 11 can attach to a canteen 25, open container or a hydration system (not shown). When a user wants to dispense a cooled liquid, he or she can depress release valve 19. When compressed gas escapes from can 18, there is a rapid pressure decrease within the can 18. As the pressure within the can decreases, the temperature of the gas in the can 18 also decreases, as well. The exterior surface 20 of the can becomes cold due to the reduction in temperature. Heat from the liquid contained in the canteen can be transferred to the container thereby reducing the temperature of the liquid in the canteen. The temperature of the liquid adjacent to the container will be lowered first. This is the liquid that is preferably made available to the user. The heat exchanger 21, if present, facilitates the heat transfer as well. As the user lifts the canteen to his or her mouth, the liquid runs through the housing 11 and contacts the heat exchanger 21 and can 18. The liquid transfers its heat to the can and heat exchanger, and the user is presented with a cooled liquid.

In an alternative embodiment, housing 11 may be manufactured out of a flexible non-toxic material, such as silicone. In this embodiment, the present apparatus can be attached to a hydration system or other suitable receptacle for holding a portable liquid used for drinking. The housing may be a softbite valve that the user can bite down on to release cooled liquid.

In a further embodiment, an upper portion, or the entire exterior surface, of the can of compressed gas may be threaded. In this embodiment, the can may be inserted into the canteen, open container or hydration system; thus, the can will be immersed in the liquid therein. A user can depress the release valve, initiating the temperature change, and the entire amount of liquid can be cooled. This embodiment may be useful if a user or another is suffering from exhaustion, sun stroke, or fatigue. Thus, a relatively large amount of cooled liquid may be necessary to control the person's core temperature.

In yet a further embodiment, the present device may be incorporated into a liquid container, such as an aluminum can. In this embodiment, the can of compressed gas may be fully included within the aluminum can. The release valve may be outside of the aluminum can. Hence, if the contents of the can have become warm, the user may depress the release valve and cool the liquid within the aluminum can. In this manner, the can of compressed gas may be attached to the underside of the top surface of the aluminum can. This attachment can create an airtight seal, which would allow the contents of the aluminum can to remain carbonated.

Figure 4:
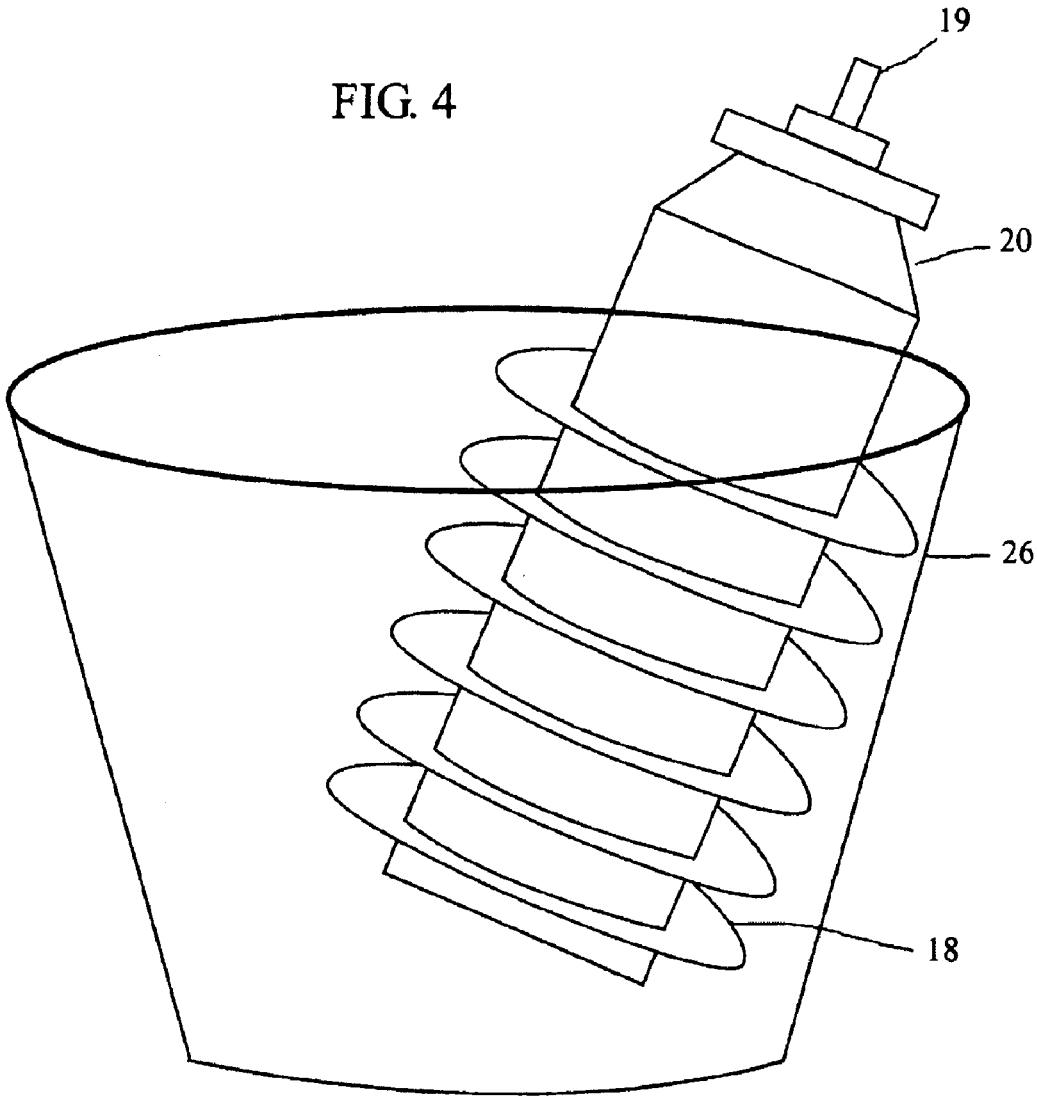
FIG. 4 is a perspective view of the present invention as used in a open container.

In still yet a further embodiment, the present device may be disposed in an open container 26, such as a cup, bucket, or glass, as seen in FIG. 4. In this embodiment, the can of compressed gas may be generally disposed along the sidewall of the open container. In one embodiment, the can may be attached to the open container as if the container and can were a solitary unit. Or, the can may be removably attached to the open container to allow for replacement and cleaning.

Figure 5:
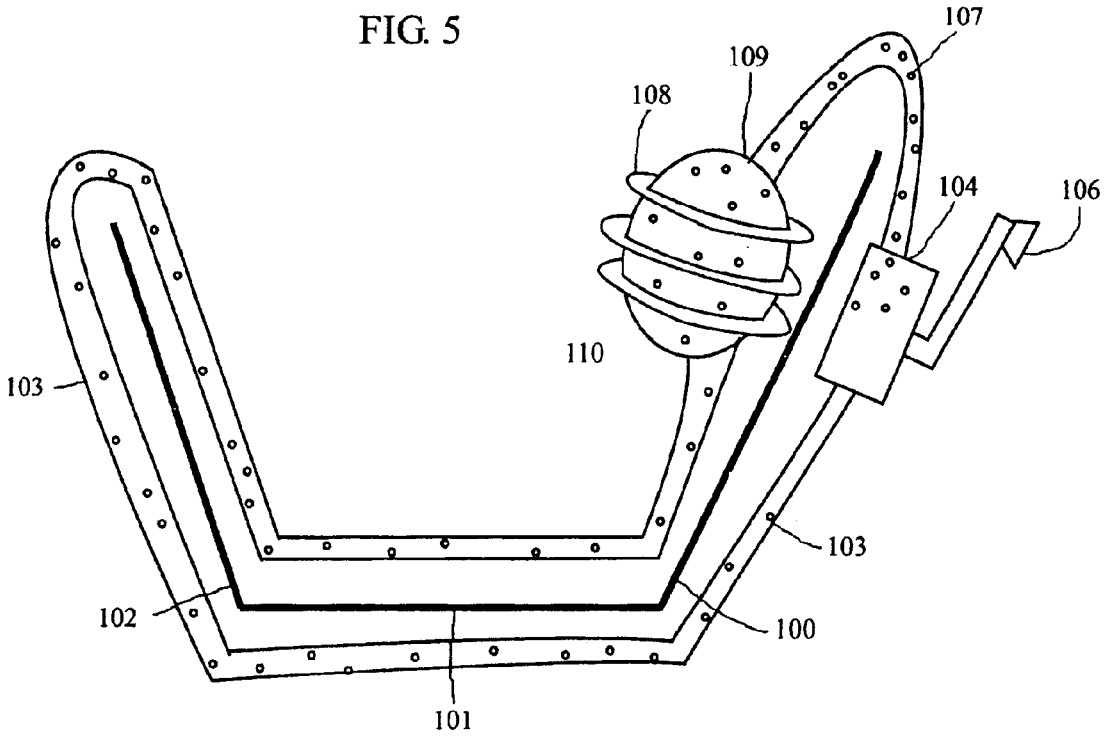
FIG. 5 is a cross-sectional view of a separate embodiment of the present invention in an open container.

As seen in FIG. 5, a further embodiment of the present device can be disposed in an open container 100. Open container 100 may be a cup, glass, bucket, small trough, etc. Open container 100 may have a bottom wall 101 and a preferably cylindrical sidewall 102. Riding along the outer surface of the open container 100 may be a length of tubing 103. Tubing 103 may be made of plastic or rubber, and is preferably non-toxic as a liquid placed in the open container 100 may contact the tubing 103. Tubing 103 preferably has an inlet 104 attached to a compressor 105. Compressor 105 is preferably small enough to fit on the sidewall 102 of the open container 100. In one embodiment, the compressor 105 is hand-powered by crank 106. Rotation of crank 106 can run compressor 105. In an alternate embodiment, the compressor is powered by a small battery, such as a nine volt.

Operation of compressor 105 pumps a refrigerant 107 in a tubing 103 to an expansion chamber 108. The refrigerant 107 can be carbon dioxide, 134*a*, etc. In one embodiment, tubing 103 is equipped with a restriction area 109 that feeds into expansion chamber 108. Expansion chamber 108 may have a plurality of heat exchangers 110 to disperse the cooling sensation into the liquid in the open container 100. In a further embodiment, a Sterling engine may be used in place of the compressor, to move refrigerant around the tubing of the open container.

What is claimed is:

1. An apparatus for cooling a liquid in a portable container said portable container having a body for holding a liquid and an opening for removing said liquid from said body, said apparatus comprising: a housing, said housing having a first end and a second end, said second end adapted to be removably secured to said opening of said portable container; said housing having a can of compressed gas within said housing, said can having a release valve at said first end of said can to release said compressed gas; said can having a heat exchanger around at least a portion of an exterior surface of said can and wherein said heat exchanger absorbs heat from a liquid in said container when said liquid passes from said portable container into said housing and flows between the external surface of said can and an interior wall of said housing.

2. An apparatus according to claim 1 wherein said housing is a hollow cylinder.

3. An apparatus according to claim 1 wherein said top end of said housing has a bevel for pouring and drinking liquid from said container.

4. An apparatus according to claim 1 wherein said bottom end of said housing is rubber.

5. An apparatus according to claim 1 wherein said heat exchanger is a plurality of fins.

6. An apparatus according to claim 5 wherein said fins are disc-shaped.

7. An apparatus according to claim 1 wherein said heat exchanger is a porous mesh of metal.

8. An apparatus according to claim 1 wherein said heat exchanger is made out of aluminum.

9. An apparatus according to claim 1 wherein said heat exchanger is made out of copper.

10. An apparatus according to claim 1 wherein said portable container is a canteen.

11. An apparatus according to claim 1 wherein said portable container is a hydration system.

12. An apparatus according to claim 1 wherein said portable container is an open container.

13. An apparatus according to claim 1 wherein said second end of said housing is threaded to be removably secured to a threaded opening in said portable container.

14. An apparatus according to claim 1 wherein said can of compressed gas has a release nozzle that has an open position and closed position.

15. An apparatus according to claim 14 wherein said release valve is in an open position when downward pressure is placed on said valve and said valve is in a closed position when said pressure is released.

16. An apparatus according to claim 14 wherein said release valve is in an open position when said valve is pushed to one side and said valve is in a closed position when said valve is released.

17. An apparatus for cooling a liquid in a portable container, said portable container having a body for holding a liquid and an opening for removing said liquid from said body, said apparatus comprising a housing having a top end and a bottom end, said bottom end adapted to be removably secured to said opening in said portable container, said housing having a receptacle containing a compressed gas and a valve means for releasing said compressed gas, said receptacle having an exterior surface, and wherein said exterior surface of said receptacle has a first temperature prior to a release of compressed gas through said valve means and a second lower temperature after release of compressed gas through said valve means, said exterior surface of said receptacle cooling said liquid in said portable container as said liquid flows between said housing and said exterior surface of said receptacle.

* * * * *